US008769782B2

(12) United States Patent
Fujikawa

(10) Patent No.: US 8,769,782 B2
(45) Date of Patent: Jul. 8, 2014

(54) RESIN MOLDED PARTS LOCK MECHANISM

(75) Inventor: Ryo Fujikawa, Makinohara (JP)

(73) Assignee: Yazaki Corporation, Tokyo (JP)

( * ) Notice: Subject to any disclaimer, the term of this patent is extended or adjusted under 35 U.S.C. 154(b) by 7 days.

(21) Appl. No.: 13/498,996

(22) PCT Filed: Sep. 28, 2010

(86) PCT No.: PCT/JP2010/066871

§ 371 (c)(1),
(2), (4) Date: Mar. 29, 2012

(87) PCT Pub. No.: WO2011/040420

PCT Pub. Date: Apr. 7, 2011

(65) Prior Publication Data

US 2012/0180274 A1 Jul. 19, 2012

(30) Foreign Application Priority Data

Sep. 29, 2009 (JP) ..... 2009-224222

(51) Int. Cl.
*H01R 3/00* (2006.01)
*H01R 13/40* (2006.01)

(52) U.S. Cl.
USPC ..... 24/593.1; 439/282; 439/489; 439/595

(58) Field of Classification Search
CPC ..... A43C 11/148; A43C 11/1486; A42B 1/22
USPC ..... 24/593.1, 593.11, 595.1, 596.1, 614, 24/615, 625; 439/282, 350, 352, 353, 357, 439/358
See application file for complete search history.

(56) References Cited

U.S. PATENT DOCUMENTS 5,605,472 A * 2/1997 Sakai et al. ..... 439/489
5,931,700 A * 8/1999 Saito et al. ..... 439/595

(Continued)

FOREIGN PATENT DOCUMENTS

CN 100384024 C 4/2008
CN 101359794 A 2/2009

(Continued)

OTHER PUBLICATIONS

International Search Report dated Nov. 2, 2010 issued in International Application No. PCT/JP2010/066871(PCT/ISA/210).

(Continued)

*Primary Examiner* — Robert J Sandy
*Assistant Examiner* — Rowland Do
(74) *Attorney, Agent, or Firm* — Sughrue Mion, PLLC

(57) ABSTRACT

The first projecting portion (12) which is situated close to the entrance of the lock hole (11) imparts a reaction force to the lock arm (21) from therebehind so as to push the lock arm (21) towards the second projecting portion (13). Therefore, the engagement force of the permanent locking projection (23) on the lock arm (21) with the second projecting portion (13) on the lock hole can be enhanced, thereby making it possible to enhance the lock holding force. In addition, without the pressure imparted from the first projecting portion (12) to a back of the lock arm (21), the lock arm (21) would flex about the proximal end portion thereof, as a fulcrum, which is a support portion where to support the lock arm (21) which is the cantilever-shaped arm.

6 Claims, 4 Drawing Sheets

(56) References Cited

U.S. PATENT DOCUMENTS

| | | | | |
|---|---|---|---|---|
| 5,974,639 | A * | 11/1999 | Keller | 24/662 |
| 6,669,510 | B2 * | 12/2003 | Yamawaki et al. | 439/595 |
| 2002/0119693 | A1 | 8/2002 | Chen | |
| 2003/0027456 | A1 | 2/2003 | Yamawaki et al. | |
| 2006/0014414 | A1 | 1/2006 | Sakamoto et al. | |
| 2007/0264863 | A1 | 11/2007 | Nakamura | |
| 2008/0233789 | A1 | 9/2008 | Sakamoto et al. | |
| 2009/0035981 | A1 | 2/2009 | Lim | |
| 2009/0186524 | A1 | 7/2009 | Maesoba et al. | |
| 2011/0097932 | A1 * | 4/2011 | Aihara et al. | 439/607.01 |

FOREIGN PATENT DOCUMENTS

| | | | |
|---|---|---|---|
| EP | 1 282 200 | A2 | 2/2003 |
| EP | 1 463 158 | A2 | 9/2004 |
| EP | 2 081 260 | A1 | 7/2009 |
| JP | 454160 | U | 5/1992 |
| JP | 2000340295 | A | 12/2000 |
| JP | 2002117936 | A | 4/2002 |
| JP | 2007305541 | A | 11/2007 |
| JP | 2008130323 | A | 6/2008 |
| JP | 2008226590 | A | 9/2008 |

OTHER PUBLICATIONS

Written Opinion dated Nov. 2, 2010 issued in International Application No. PCT/JP2010/066871 (PCT/ISA/237).

Office Action, dated May 7, 2013, issued by the Japanese Patent Office in counterpart Japanese Application No. 2011-534256.

Communication dated Jan. 13, 2014 issued by the State Intellectual Property Office of the People's Republic of China in counterpart Chinese Patent Application No. 201080043313.5.

Communication dated Apr. 24, 2014 issued by the European Patent Office in corresponding European Application No. 10820535.2.

* cited by examiner (a)

(b)

RESIN MOLDED PARTS LOCK MECHANISM

TECHNICAL FIELD

The present invention relates to a resin molded parts lock mechanism.

BACKGROUND ART

When two resin molded parts are joined together, a lock mechanism is widely used in which a lock arm having flexibility is formed on one resin molded part and a lock projection is provided on the other resin molded part, the locking projection being adapted to be brought into engagement with an engagement projection on the lock arm by making use of the flexure of the lock arm.

FIG. 4 shows the configuration of a lock mechanism of a type described in Patent Literature 1, for example. FIG. 4(*a*) shows a pre-lock state, and (*b*) shows a post-lock state at (*b*). Reference numeral 120 denotes a lock arm provided on the one resin molded part, and an engagement projection 121 is provided at a distal end thereof. In addition, a lock projection 111 is provided at a lock portion 110 of the other resin molded part, the lock projection 111 being adapted to be brought into engagement with the engagement projection 121 of the lock arm 120.

In this lock mechanism, when the lock arm 120 moves upwards (in a direction indicated by an arrow J) relative to the lock portion 110 from the state shown in FIG. 4(*a*), the engagement projection 121 rides over the lock projection 111 by making use of the flexure of the lock arm 120. Then, as shown in FIG. 4(*b*), the engagement projection 121 and the lock projection are brought into engagement with each other in the position where the engagement projection 121 has ridden over the lock projection 111. Thus, the locked state is ensured.

RELATED ART LITERATURE

Patent Literature

Patent Literature 1: JP-A-2008-130323

SUMMARY OF THE PRESENT INVENTION

Problem that the Present Invention is to Solve

However, when the locked state is held only by the engagement between the engagement projection of the lock arm and the lock projection on the mating part as in the conventional lock mechanism described above, there exists a problem that the engagement force cannot be made too strong. In addition, there also exists a problem that the lock holding force cannot be exhibited as designed due to deformation or dimension error at the time of molding.

The present invention has been made in view of these situations, and an object thereof is to provide a resin molded parts lock mechanism which can enhance the lock holding force as designed even when deformation or dimension error is produced at the time of molding.

Means for Solving the Problem (1) With a view to solving the problem, according to the present invention, there is provided a resin molded parts lock mechanism for locking two resin molded parts together made up of a lock hole formed in one resin molded part, and a lock arm formed as a cantilever-shaped arm on the other resin molded part and adapted to be inserted into the lock hole from an entrance towards a deeper side thereof so as to be locked in the lock hole by making use of flexure thereof, and comprising a first projecting portion and a second projecting portion, the first projecting portion being provided, of inner wall surfaces, facing each other, of the lock hole which follow an inserting direction of the lock arm and face in flexing directions of the lock arm, on a first inner wall surface in a position lying close to the entrance so as to project therefrom, the second projecting portion being provided on a second inner wall surface in a position lying deeper than the first projecting portion so as to project therefrom, and a permanent locking projection provided on a first side surface of the lock arm in a position lying at a distal end in the inserting direction of the lock arm into the lock hole to face the second projecting portion so as to project therefrom, the permanent locking projection being adapted to ride over the second projecting portion as a result of the lock arm flexing in association with an inserting operation of the lock arm into the lock hole and then to be brought into engagement with the second projecting portion in a position where the permanent locking projection has ridden over the second projecting portion to thereby prevent the lock arm from being dislodged from the lock hole, wherein when the permanent locking projection is in engagement with the second projecting portion, the first projecting portion presses against a second side surface of the lock arm which lies opposite to the first side surface to thereby impart a reaction force directed towards the second projecting portion to the lock arm.

(2) In the resin molded parts lock mechanism of the present invention, it is preferable that a temporary locking projection is provided on the second side surface of the lock arm, the temporary locking projection being adapted to ride over the first projecting portion due to the flexure of the lock arm in association with an inserting operation of the lock arm into the lock hole before the permanent locking projection reaches the second projecting portion and then to be brought into engagement with the first projecting portion in a position where the temporary locking projection has ridden over the first projecting portion to thereby lock the lock arm so as to prevent the lock arm from being dislodged from the lock hole, and that a space defined between the lock arm and the second inner surface of the lock hole when the temporary locking projection is in engagement with the first projecting portion is set smaller than an engagement area between the temporary locking projection and the first projecting portion.

(3) In the resin molded parts lock mechanism of the present invention, it is preferable that inclined guide surfaces are provided on the first projecting portion and a wall surface of the second projecting portion which lies to face the entrance for smoothly guiding the lock arm when the lock arm is inserted towards the deeper side of the lock hole.

(4) In the resin molded parts lock mechanism of the present invention, it is preferable that an abutment wall surface is provided on the second side surface of the lock arm so as to be brought into abutment with the inclined guide surface of the first projecting portion when the permanent locking projection and the second projecting portion are brought into engagement with each other.

(5) In the resin molded parts lock mechanism of the present invention, it is preferable that striking surfaces are provided at the entrance of the lock hole and a proximal end portion of the lock arm so as to be caused to strike each other when the permanent locking projection and the second projecting portion are brought into engagement with each other to thereby restrict a further movement of the lock arm towards the deeper side of the lock hole.

Advantage of the Present Invention

According to the lock mechanism described under (1) above, the first projecting portion which is situated close to the entrance of the lock hole imparts a reaction force to the lock arm from therebehind so as to push the lock arm towards the second projecting portion. Therefore, the engagement force of the permanent locking projection on the lock arm with the second projecting portion on the lock hole can be enhanced, thereby making it possible to enhance the lock holding force. In addition, without the pressure imparted from the first projecting portion to a back of the lock arm, the lock arm would flex about the proximal end portion thereof, as a fulcrum, which is a support portion where to support the lock arm which is the cantilever-shaped arm. However, the lock arm is supported by the first projecting portion in a position which lies further distal than the proximal end portion thereof, the support portion where the lock arm is supported by the first projecting portion functions as a different fulcrum, which shortens the length of a substantial flexing portion of the lock arm, whereby the lock arm is made difficult to flex accordingly in a direction in which the engagement between the second projecting portion and the permanent locking projection is released. Consequently, the locked state is made difficult to be released, whereby the lock holding force is enhanced. In this case, the locking force can be enhanced by inserting the lock arm into the lock hole, and therefore, even when a slight deformation or dimension error is produced at the time of molding, a sufficiently high lock holding force can be maintained. Additionally, when the permanent locking projection rides over the second projecting portion, the lock arm is restored from the flexure, whereby the first side face of the lock arm is allowed to strike the second projecting portion. This enables the operator to hear a striking sound produced then as a lock sound, and therefore, the operator can recognize that the lock arm is locked properly in the lock hole by confirming the lock sound.

According to the lock mechanism described under (2) above, the temporary locking projection of the lock arm is brought into engagement with the first projecting portion, whereby the lock arm is temporarily locked. Therefore, the lock arm can be caused to stay in the temporarily locked state occurring before the lock arm is shifted into a permanent locking. In addition, in the temporarily locked state, the space defined between the lock arm and the second inner surface of the lock hole is set smaller than the engagement area between the temporary locking projection and the first projecting portion. Therefore, the temporary locking between the temporary locking projection and the first projecting portion is never unlocked unless the lock arm is forced to flex, thereby making it possible to enhance the holding force at the time of temporary locking. In addition, the temporary locking is attained by the temporary locking projection and the first projecting portion before the permanent locking projection reaches the second projecting portion, that is, before the permanent locking projection rides over the second projecting portion. Therefore, the lock arm is never unintentionally shifted from the temporarily locked state to the permanently locked state.

According to the lock mechanism described under (3) above, the inclined guide surfaces are provided on the first projecting portion and the wall surface of the second projecting portion which lies to face the entrance, and therefore, the lock arm can be smoothly inserted into the lock hole when the lock arm is inserted into the lock hole.

According to the lock mechanism described under (4) above, the abutment wall surface of the lock arm is brought into abutment with the inclined guide surface of the first projecting portion of the lock hole in the permanently locked state in which the permanent locking projection of the lock arm is brought into engagement with the second projecting portion of the lock hole. Therefore, the permanently locked state free from looseness can be held.

According to the lock mechanism described under (5) above, the striking surfaces of the lock hole and the proximal end portion of the lock arm are caused to strike each other in the permanently locked state in which the permanent locking projection of the lock arm is brought into engagement with the second projecting portion of the lock hole. Therefore, the lock arm can be locked in the lock hole in an ensured fashion against both the inserting and dislodging directions.

MODE FOR CARRYING OUT THE PRESENT INVENTION

First Embodiment

Hereinafter, a first embodiment of the present invention will be described by reference to FIGS. 1 and 2.

Figure 1:
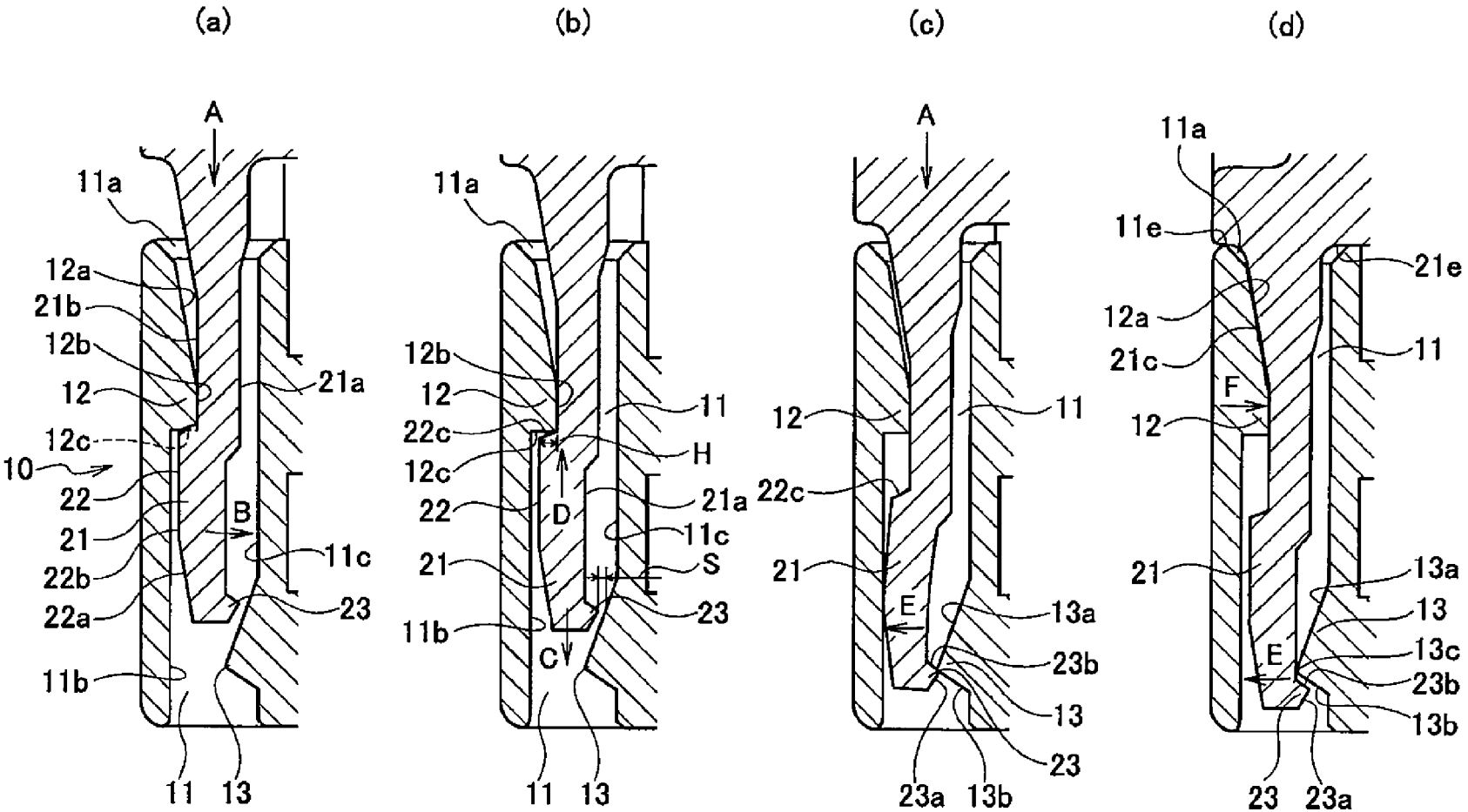
FIG. 1 shows sectional views of a lock mechanism of a first embodiment of the present invention showing states which illustrate together an order in which locking progresses at (*a*) to (*d*), in which (*a*) shows a state occurring just before a temporary locking, (*b*) shows a temporarily locked state, (*c*) shows a state occurring just before a permanent locking, and (*d*) shows a permanently locked state.

FIG. 1 shows sectional views of a lock mechanism of a first embodiment of the present invention showing states which illustrate together an order in which locking progresses at FIG. 1(*a*) to (*d*), in which (*a*) shows a state occurring just before a temporary locking, (*b*) shows a temporarily locked state, (*c*) shows a state occurring just before a permanent locking, and (*d*) shows a permanently locked state. FIG. 2 is an external perspective view of a connector which employs the lock mechanism.

Figure 2:
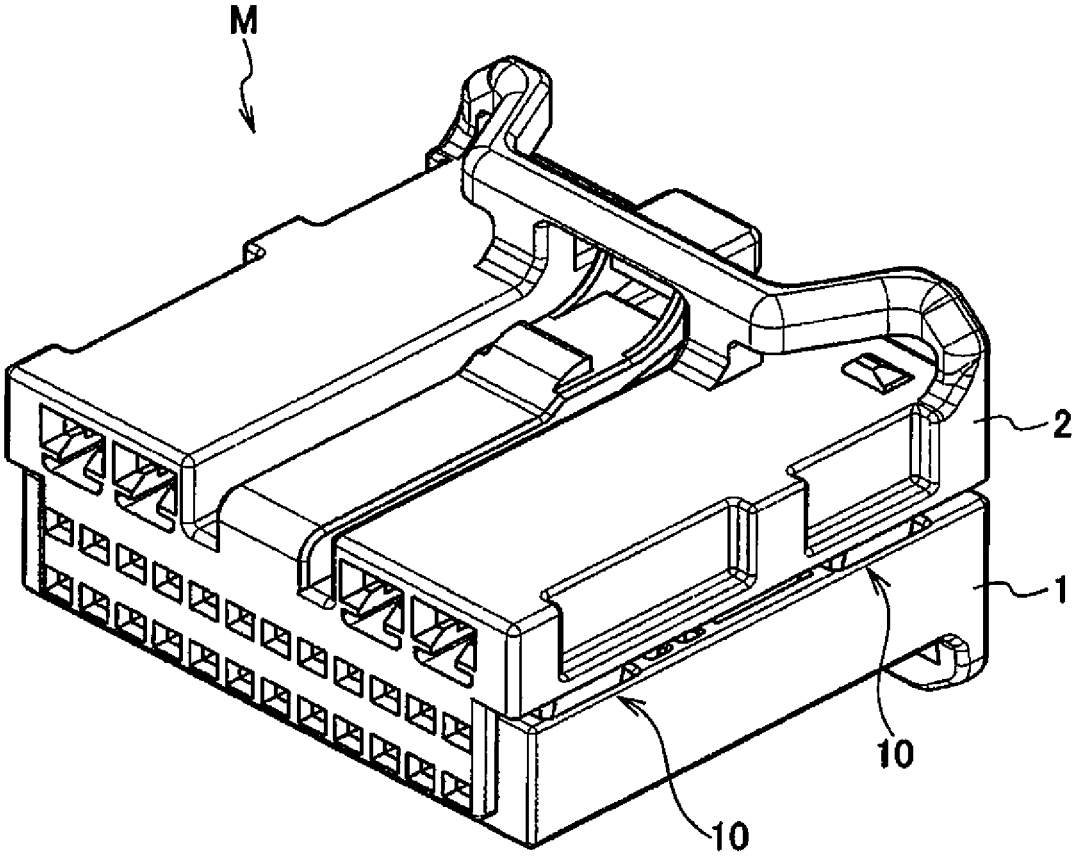
FIG. 2 is an external perspective view of a connector which employs the lock mechanism of the embodiment.

As shown in FIG. 2, a lock mechanism 10 of this embodiment is used as a lock device when joining vertically together two housings (resin molded parts) 1, 2 so as to build up a connector M.

As shown in FIG. 1, this lock mechanism 10 includes a lock hole 11 having a rectangular section which is formed in one housing 1 (refer to FIG. 2) and a lock arm 21 having a rectangular section (a strip-like shape) which is formed on the other housing 2 (refer to FIG. 2) as a cantilever-shaped arm so as to be locked in the lock hole 11 by making use of the flexure thereof by being inserted into the lock hole 11 from an entrance 11*a* towards a deeper side thereof.

Two projecting portions 12, 13 are provided in an interior of the lock hole 11. Namely, of inner wall surfaces 11*b*, 11*c*, facing each other, of the lock hole 11 which follow an inserting direction A of the lock arm 21 and face in flexing directions B, E of the lock arm 21, a first projecting portion 12 is provided on a first inner wall surface 11*b* in a position lying close to the entrance 11*a* so as to project therefrom, and a second projecting portion 13 is provided on a second inner wall surface 11*c* in a position lying deeper than the first projecting portion 12 so as to project therefrom. As will be described later, the former is a temporary locking device, and the latter is a permanent locking device.

On the other hand, a permanent locking projection 23 is provided on a first side surface 21*a* of the lock arm 21 in a position lying at a distal end in the inserting direction of the lock arm 21 into the lock hole 11 (in the direction indicated by an arrow A) to face the second projecting portion 13 so as to project therefrom, the permanent locking projection 23 being adapted to ride over the second projecting portion 13 as a result of the lock arm 21 flexing in association with an inserting operation of the lock arm 21 into the lock hole 11 and then to be brought into engagement with a distal end locking wall (a locking surface) 13*b* of the second projecting portion 13 in a position where the permanent locking projection 23 has ridden over the second projecting portion 13 to thereby prevent the lock arm 21 from being dislodged from the lock hole 11.

The permanent locking projection 23 has an angle-shaped section. Hence, wall surfaces of the permanent locking projection 23 which lie to face the distal end and proximal end of the lock arm 21 are both formed into inclined surfaces 23*a*, 23*b*. This configuration is intended to enable the permanent locking projection 23 to easily ride over the second projecting portion 13 when the lock arm 21 is locked on and unlocked from the distal end locking wall 13*b* of the second projecting portion 13. Here, the distal end side wall surface (inclined surface) 23*b* is a wall surface which functions as a locking wall.

In this case, as shown in FIG. 1(*d*), the first projecting portion 12 is a portion which imparts a reaction force F which is directed towards the second projecting portion 13 to the lock arm 21 while the permanent locking projection 23 of the lock arm 21 is in engagement with the second projecting portion 13 of the lock hole 11 by pressing against the first side surface 21*a* and the second side surface 21*b*, which lies opposite to the first side surface 21*a*, of the lock arm 21. Thus, the first projecting portion 12 is formed into the shape of a projecting wall which projects inwards. A top surface 12*b* of the first projecting portion 12 is formed into a flat plane so as to be brought into close abutment with the second side face 21*b* of the lock arm 21.

In addition, a temporary locking projection 22 is provided on the second side surface 21*b* of the lock arm 21. This temporary locking projection 22 is adapted as shown in FIG. 1(*b*) to ride over the first projecting portion 12 as a result of the lock arm 21 flexing in association with an inserting operation of the lock arm 21 into the lock hole 11 before the permanent locking projection 23 reaches the second projecting portion 13 and then to be brought into engagement with the first projecting portion 12 in a position where the temporary locking projection 22 has ridden over the first projecting portion 12 to thereby prevent the lock arm 21 from being dislodged from the lock hole 11.

The temporary locking projection 22 is also formed into the shape of a projecting wall which projects towards the first projecting portion 12. In the temporary locking projection 22, a wall surface which lies at a distal end portion in the inserting direction (the direction indicated by the arrow A) of the lock arm 21 is formed into an inclined guide surface 22*a*, a top surface 22*b* is formed into a wall surface which is parallel to the inserting direction A, and a wall surface which lies opposite to the inclined guide surface 2*a* in the inserting direction is formed into an engagement surface 22*c* which can be brought into engagement with a locking wall 12*c* of the first locking portion 12.

In addition, as shown in FIG. 1(*b*), a space S defined between the lock arm 21 or, specifically speaking, an apex portion of the permanent locking projection 23 provided on the first side surface 21*a* and the second inner wall surface 11*c* of the lock hole 11 when the temporary locking projection 22 and the first projecting portion 12 are in engagement with each other is set so as to be smaller than an engagement area H between the temporary locking projection 22 and the first projecting portion 12.

Additionally, inclined guiding surfaces 12*a*, 13*a* are provided on the first projecting portion 12 and a wall surface of the second projecting portion 13 which lies to face the entrance 11*a* so as to guide the lock arm 21 smoothly when the lock arm 21 is inserted into the deeper side of the lock hole 11. A distal end side wall surface of the second projecting portion 13 is formed into a locking surface 13*b*. Then, an apex 13*c* of the second projecting portion 13 where the locking surface 13*b* intersects the inclined guide surface 13*a* is caused to be tapered off to an angle shape.

An abutment wall surface 21*c* is provided on the second side surface 21*b* of the lock arm 21. This abutment wall surface 21*c* is brought into abutment with the inclined guide surface 12*a* of the first projecting portion 12 when the permanent locking projection 23 is brought into engagement with the second projecting portion 13.

Further, striking surfaces 11*e*, 21*e* are provided at the entrance 11*a* of the lock hole 11 and a proximal end portion of the lock arm 21, respectively, so as to strike each other to thereby restrict a further movement of the lock arm 21 towards the deeper side of the lock hole 11 when the permanent locking projection 23 is brought into engagement with the second projecting portion 13.

Next, the function of the lock mechanism 10 will be described.

Firstly, as shown in FIG. 1(*a*), when the distal end of the lock arm 21 is inserted into the lock hole 11 along the inserting direction A, the temporary locking projection 22 of the lock arm 21 interferes with the first projecting portion 12, whereby the lock arm 21 flexes in the direction of the arrow B. When the temporary locking projection 22 of the lock arm 21 rides over the first projecting portion 12 of the lock hole 11, as shown in FIG. 1(*b*), the lock arm 21 is restored from the flexure, and the locking surface 22*c* of the temporary locking projection 22 and the locking wall 12*c* of the first projecting portion 12 face each other, whereby the temporary locking projection 22 is brought into engagement with the first projecting portion 12. By this engagement, the lock arm 21 is being temporarily locked in the lock hole 11, whereby the lock arm 21 is held so as not to be dislodged in a direction indicated by an arrow D.

In this temporarily locked state, the engagement area H between the temporary locking projection 22 and the first projecting portion 12 is larger than the space S defined between the first side surface 21*a* of the lock arm 21 and the second inner wall surface 11*c* of the lock hole 11, therefore, the temporary locking between the temporary locking projection 22 and the first projecting portion 12 is never unlocked as long as the lock arm 21 is not forced to flex, whereby the holding force at the time of temporary locking is maintained high.

This temporarily locked state is attained before the permanent locking projection 23 reaches the second projecting portion 13, that is, the permanent locking projecting 23 rides over the second projecting portion 13. Therefore, there is caused no such situation that the lock arm 21 is unintentionally pushed into a direction indicated by an arrow C to thereby be shifted from the temporarily locked state to a permanently locked state.

Next, in order for the lock arm 21 to be shifted from the temporarily locked state to the permanently locked, as shown in FIG. 1(*c*), the lock arm 21 is pushed further in the direction indicated by the arrow A. Then, this time, the permanent locking projection 23 of the lock arm 21 interferes with the second projecting portion 13 of the lock hole 11, whereby the lock arm 21 flexes in a direction indicated by an arrow E. Then, when the permanent locking projection 23 of the lock arm 21 rides over the second projecting portion 13 of the lock hole 11 while the lock arm 21 is flexing, as shown in FIG. 1(*d*), the lock arm 21 is restored from the flexure, the inclined surface (the locking surface) 23*b* of the permanent locking projection 23 faces the locking surface 13*b* of the second projecting portion 13, whereby the permanent locking projection 23 and the second projecting portion 13 are brought into engagement with each other. This enables the lock arm 21 to be permanently locked in the lock hole 11, whereby the lock arm 21 is held in an ensured fashion so as not to be dislodged from the lock hole 11.

When this permanently locked state is attained, the first projecting portion 12 which is situated close to the entrance 11*a* of the lock hole 11 imparts a reaction force to the lock arm 21 from therebehind so as to push the lock arm 21 towards the second projecting portion 13. Therefore, the engagement force of the permanent locking projection 23 on the lock arm 21 with the second projecting portion 13 on the lock hole 11 can be enhanced, thereby making it possible to enhance the lock holding force.

In addition, without the pressure imparted from the first projecting portion 12 to a back of the lock arm 21, the lock arm 12 would flex about the proximal end portion thereof, as a fulcrum, which is a support portion where to support the lock arm 21 which is the cantilever-shaped arm. However, the lock arm 21 is supported by the first projecting portion 12 in a position which lies further distal than the proximal end portion thereof, the support portion where the lock arm 21 is supported by the first projecting portion 12 functions as a different fulcrum, which shortens the length of a substantial flexing portion of the lock arm 21, whereby the lock arm 21 is made difficult to flex accordingly in a direction in which the engagement between the second projecting portion 13 and the permanent locking projection 23 is released. Consequently, the locked state is made difficult to be released, whereby the lock holding force is enhanced.

In this case, the locking force can be enhanced by inserting the lock arm 21 into the lock hole 11, and therefore, even when a slight deformation or dimension error is produced at the time of molding, a sufficiently high lock holding force can be maintained.

Additionally, when the permanent locking projection 23 rides over the second projecting portion 13, the lock arm 21 is restored from the flexure, whereby the first side face 21*a* of the lock arm 21 is allowed to strike the second projecting portion 13. This enables the operator to hear a striking sound produced then as a lock sound, and therefore, the operator can recognize that the lock arm 21 is locked properly in the lock hole 11 by confirming the lock sound. In particular, the apex 13*c* of the second projecting portion 13 is tapered off, and therefore, the striking surface is reduced, and this serves to generate a clear strong striking sound, enabling the operator to determine easily whether or not the lock arm 21 is properly locked in the lock hole 11 in an ensured fashion.

When the permanently locked state is attained, the abutment wall surface 21*c* of the lock arm 21 is brought into abutment with the inclined guide surface 12*a* of the first projecting portion 12 of the lock hole 11. Therefore, the permanently locked state free from looseness can be maintained. Further, the striking surfaces 11*e*, 21*e* of the lock hole 11 and the proximal end portion of the lock arm 21 strike each other when the permanently locked state is attained. Therefore, the lock arm 21 can be locked in the lock hole 11 in an ensured fashion against both the inserting and dislodging directions.

In addition, the inclined guide surfaces 12*a*, 13*a* are formed on the first projecting portion 12 and the wall surface of the second projecting portion 13 which lies to face the entrance 11*a*, respectively, so as to facilitate the inserting operation of the lock arm 21 for temporary locking and permanent locking. Therefore, the lock arm 21 can smoothly be inserted into the lock hole 11.

Second Embodiment

Next, a second embodiment of the present invention will be described. In the second embodiment, like reference numerals are given to like portions to those described in the first embodiment, and the description thereof will be omitted.

Figure 3:
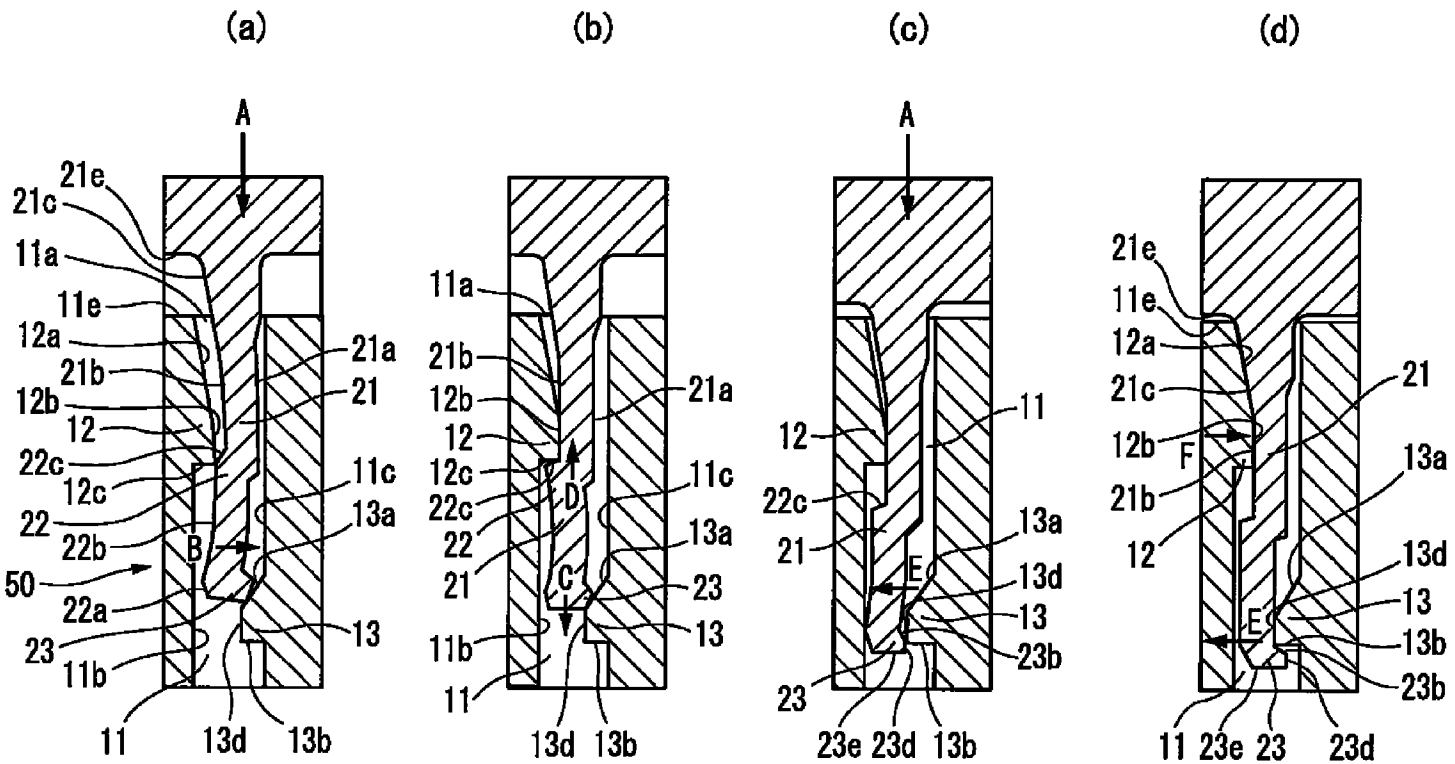
FIG. 3 shows sectional views of a lock mechanism of a second embodiment of the present invention showing states which illustrate together an order in which locking progresses at (*a*) to (*d*), in which (*a*) shows a state occurring just before a temporary locking, (*b*) shows a temporarily locked state, (*c*) shows a state occurring just before a permanent locking, and (*d*) shows a permanently locked state.
Figure 4:
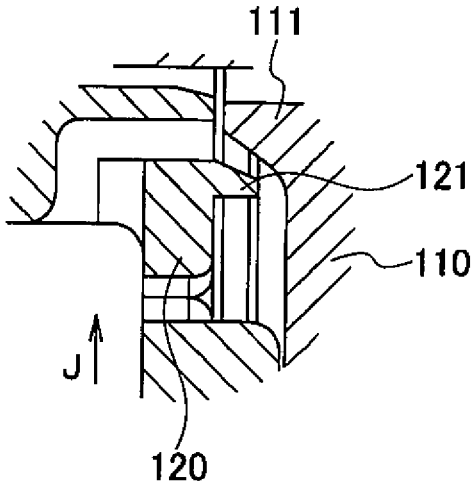
FIG. 4 shows sectional views of a conventional lock mechanism, of which (*a*) shows a pre-lock state, and (*b*) shows a post-lock state.
Figure 4:
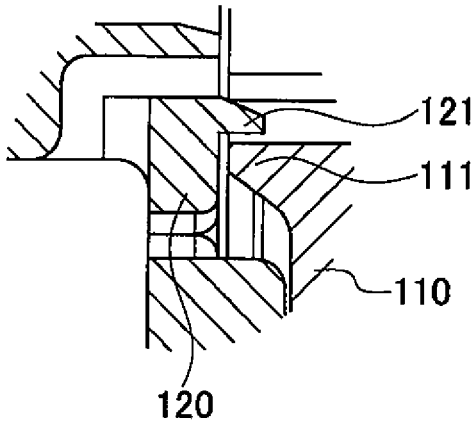

FIG. 3 shows sectional views of a lock mechanism of the second embodiment of the present invention showing states which illustrate together an order in which locking progresses at (*a*) to (*d*), in which (*a*) shows a state occurring just before a temporary locking, (*b*) shows a temporarily locked state, (*c*) shows a state occurring just before a permanent locking, and (*d*) shows a permanently locked state.

In a lock mechanism 50 of the second embodiment, as shown in FIG. 3, a second projecting portion 13, which is provided on the second inner wall 11*c* of the lock hole 11 in the lock mechanism 10 of the first embodiment, is formed of an inclined guide surface 13*a*, a top surface 13*d* which is continuous with the inclined guide surface 13*a* and which is substantially parallel to an inner wall surface of a lock hole 11 and a locking surface 13*b* which is continuous with the top surface 13*d*.

In addition, a permanent locking projection 23 of a lock arm 21 is formed of a wall surface (a distal end face) 23*e* which lies at a distal end of the lock arm 21, a top surface 23*d* which is continuous with the distal end face 23*e* towards a proximal end portion of the lock arm 21 and an inclined surface 23*b* which is continuous with the top surface 23*d*.

In the lock mechanism 50 of the second embodiment, as shown in FIG. 3(*a*), when the lock arm 21 is inserted into the lock hole 11 along a direction indicated by an arrow A from the distal end of the lock arm 21, an inclined guide surface 22*a* of the lock arm 21 which lies at a distal end portion thereof interferes with an inclined guide surface 12*a* of a first projecting portion 12 of the lock hole 11. Therefore, the lock arm 21 enters the lock hole 11 while flexing in a direction indicated by an arrow B. When a temporary locking projection 22 of the lock arm 21 rides over the first projecting portion 12 of the lock hole 11, as shown in FIG. 3(*b*), the lock arm 21 is restored from the flexure, and the temporary licking projection 22 and the first projecting portion 12 are brought into engagement with each other.

As shown in FIG. 3(*c*), when the lock arm 21 is pushed further in the direction indicated by the arrow A, this time, the top surface 23*d* of the permanent locking projection 23 of the lock arm 21 interferes with the inclined guide surface 13*a* of the second projecting portion 13 of the lock hole 11. Therefore, the lock arm 21 slides on the top surface 13*d* of the second projecting portion 13 to move further into the lock hole 11 while flexing in a direction indicated by an arrow E. Then, when the permanent locking projection 23 of the lock arm 21 rides over the second projecting portion 13 of the lock hole 11, as shown in FIG. 3(*d*), the lock arm 21 is restored from the flexure, and the permanent locking projection 23 and the second projecting portion 13 are brought into engagement with each other.

In the second embodiment, the surfaces (the top surfaces) 13*d*, 23*d* which are parallel to the inserting direction (the direction indicated by the arrow A) of the lock arm 21 are provided on the second projecting portion 13 of the lock hole 11 and the permanent locking projection 23 of the lock arm 21, respectively. Therefore, the lock arm 21 can be held in the lock hole 11 in an ensured fashion.

This patent application is based on Japanese Patent Application (No. 2009-224222) filed on Sep. 29, 2009, the contents of which are incorporated herein by reference.

DESCRIPTION OF REFERENCE NUMERALS

1, 2 housing (resin molded part);
10 lock mechanism;
11 lock hole;
11*a* entrance;
11*b* first inner wall surface;
11*c* second inner wall surface;
11*e* striking surface;
12 first projecting portion;
12*a* inclined guide surface;
13 second projecting portion;
13*a* inclined guide surface;
13*c* apex;
13*d* top surface;
21 lock arm;
21*a* first side surface;
21*b* second side surface;
21*c* abutment wall surface;
21*e* striking surface;
22 temporary locking projection;
23 permanent locking projection;
23*a*, 23*b* inclined surface;
23*d* top surface;
23*e* distal end face.

The invention claimed is:

1. A resin molded parts lock mechanism for locking two resin molded parts together, the resin molded parts lock mechanism comprising:

a lock hole formed in one resin molded part; and a lock arm formed as a cantilever-shaped arm on the other resin molded part and adapted to be inserted into the lock hole from an entrance towards a deeper side thereof so as to be locked in the lock hole by making use of flexure thereof, and comprising:

a first projecting portion and a second projecting portion, the first projecting portion being provided, of inner wall surfaces, facing each other, of the lock hole which follow an inserting direction of the lock arm and face in flexing directions of the lock arm, on a first inner wall surface in a position lying close to the entrance so as to project therefrom, the second projecting portion being provided on a second inner wall surface in a position lying deeper than the first projecting portion so as to project therefrom; and a permanent locking projection provided on a first side surface of the lock arm in a position lying at a distal end in the inserting direction of the lock arm into the lock hole to face the second projecting portion so as to project therefrom, the permanent locking projection being adapted to ride over the second projecting portion as a result of the lock arm flexing in association with an inserting operation of the lock arm into the lock hole and then to be brought into engagement with the second projecting portion in a position where the permanent locking projection has ridden over the second projecting portion to thereby prevent the lock arm from being dislodged from the lock hole, wherein when the permanent locking projection is in engagement with the second projecting portion, the first projecting portion presses against a second side surface of the lock arm which lies opposite to the first side surface to thereby impart a reaction force directed towards the second projecting portion to the lock arm, the lock arm being flexed in the permanent locking position.

2. The resin molded parts lock mechanism as set forth in claim 1, wherein a temporary locking projection is provided on the second side surface of the lock arm, the temporary locking projection being adapted to ride over the first projecting portion due to the flexure of the lock arm in association with an inserting operation of the lock arm into the lock hole before the permanent locking projection reaches the second projecting portion and then to be brought into engagement with the first projecting portion in a position where the temporary locking projection has ridden over the first projecting portion to thereby lock the lock arm so as to prevent the lock arm from being dislodged from the lock hole, and wherein a space defined between the lock arm and the second inner surface of the lock hole when the temporary locking projection is in engagement with the first projecting portion is set smaller than an engagement area between the temporary locking projection and the first projecting portion.

3. The resin molded parts lock mechanism as set forth in claim 1, wherein inclined guide surfaces are provided on the first projecting portion and a wall surface of the second projecting portion which lies to face the entrance for smoothly guiding the lock arm when the lock arm is inserted towards the deeper side of the lock hole.

4. The resin molded parts lock mechanism as set forth in claim 3, wherein an abutment wall surface is provided on the second side surface of the lock arm so as to be brought into abutment with the inclined guide surface of the first projecting portion when the permanent locking projection and the second projecting portion are brought into engagement with each other.

5. The resin molded parts lock mechanism as set forth in claim 4, wherein the abutment wall surface acts as a fulcrum providing a flexing force whereby a lock holding force of the permanent locking projection and the second projecting portion is enhanced.

6. The resin molded parts lock mechanism as set forth in claim 1, wherein striking surfaces are provided at the entrance of the lock hole and a proximal end portion of the lock arm so as to be caused to strike each other when the permanent locking projection and the second projecting portion are brought into engagement with each other to thereby restrict a further movement of the lock arm towards the deeper side of the lock hole.

* * * * *